United States Patent [19]

Kondo et al.

[11] Patent Number: 4,871,331

[45] Date of Patent: Oct. 3, 1989

[54] BULB SOCKET FOR WEDGED-BASE BULB

[75] Inventors: Hiroyuki Kondo; Tadashi Harada; Kihachiro Uchida, all of Shizuoka, Japan

[73] Assignees: Yazaki Corporation; Koito Manufacturing Co., Ltd., both of Tokyo, Japan

[21] Appl. No.: 198,257

[22] Filed: May 25, 1988

[51] Int. Cl.[4] ..... H01B 13/00

[52] U.S. Cl. ..... 439/736

[58] Field of Search ..... 439/736, 856, 857, 862

[56] References Cited

U.S. PATENT DOCUMENTS 3,846,735 11/1974 Carter et al. ..... 439/857

4,232,931 11/1980 Takeuchi et al. ..... 439/857

4,684,202 8/1987 House et al. ..... 439/736

*Primary Examiner*—Joseph H. McGlynn

*Attorney, Agent, or Firm*—Sughrue, Mion, Zinn, Macpeak & Seas

[57] ABSTRACT

A bulb socket for a wedged-base bulb which can be manufactured at a low cost and yet which is capable of maintaining good resilience of its contact portions over a long period of time. The socket includes a molded-resin body and a plurality of terminals partially embedded in the body as the latter is being molded. Bulb contact parts of the terminals are formed with a wall having an approximately U shape so as to surround the contact portions which pinch the wedged parts of the bulb. The wall preferably extends above the contact portions.

3 Claims, 3 Drawing Sheets

BULB SOCKET FOR WEDGED-BASE BULB

BACKGROUND OF THE INVENTION

The present invention relates to a wedged-base bulb socket for a motor vehicle light or the like, particularly to a wedged-base bulb socket in the body of which terminals are partially embedded integrally as the body of the socket is molded.

In is necessary to prevent molten resin from flowing into the contact portions (which pinch the wedged part of the bulb and come into contact with the lead wires of the bulb for making electrical connection thereto) of the bulb contact parts of the terminals as the body of a conventional bulb socket is molded from resin in such a manner that the terminals are partially embedded in the body of the bulb socket. The die used for molding the body of the conventional bulb socket from resin must be specially constituted to meet these requirements, and the constitution of the die is complicated. This significantly increases the costs of production of the conventional bulb socket.

SUMMARY OF THE INVENTION

The present invention has been made in order to solve the above-mentioned problems in the conventional bulb socket.

Accordingly, it is an object of the present invention to provide such a socket for a wedged-base bulb in which molten resin does not flow into the contact portions of the bulb contact parts of the terminals of the socket, although the die for molding the body of the socket is not specially constituted, and in which the resilience of the contact portions is maintained for long periods of time.

A further object of the present invention is to provide a socket for a wedged-base bulb in which molten resin does not flow into the contact portions of the bulb contact parts of the terminals, although the die for molding the body of the socket from the resin is not specially constituted, and in which the contact portions are less likely to be plastically deformed and can therefore maintain their resilience for a long period of time.

In the wedge-base bulb socket provided in accordance with the present invention, the terminals are partially embedded in the body of the socket as the body is molded from the resin. The bulb contact parts of the terminal are formed with a wall bent nearly in a U shape so as to surround the contact portions which pinch the wedged part of the wedged-base bulb.

In the socket provided in accordance with another aspect of the present invention, the terminals are partially embedded in the body of the socket as the body is molded from the resin. The bulb contact parts of the terminals have contact portions which pinch the wedged part of the wedged-base bulb, a wall having an approximately U shape so as to surround the contact portions as a whole, coupling portions joining the contact portions to the wall and having a relatively large width, and touch portions having nearly the same width as the coupling portions and extending from the contact portions toward the inside surface of the wall.

DESCRIPTION OF THE PREFERRED EMBODIMENTS

Preferred embodiments of the present invention will hereafter be described with reference to the attached drawings.

Figure 1:
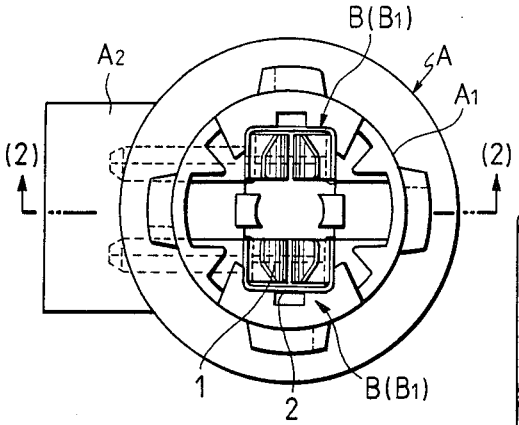
FIG. 1 shows a plan view of a bulb socket constructed according to a first preferred embodiment of the invention.
Figure 2:
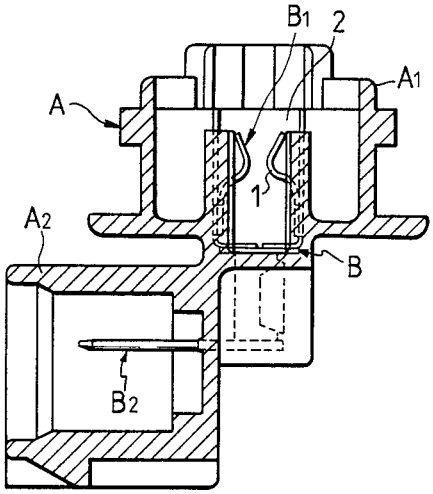
FIG. 2 shows a sectional view of the bulb socket of FIG. 1 taken along a line (2)—(2) in FIG. 1.
Figure 3:
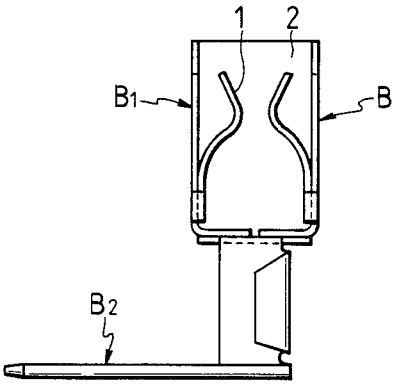
FIG. 3 shows a front view of each terminal of the bulb socket.
Figure 4:
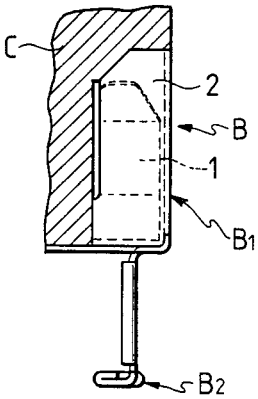
FIG. 4 shows a side view of each terminal of the bulb socket.
Figure 5:
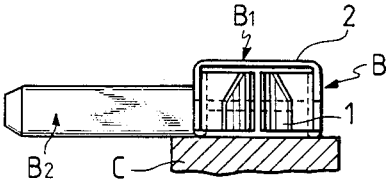
FIG. 5 shows a plan view of the terminal.

A first preferred embodiment of the invention will be described with reference to FIGS. 1 through 5 of the drawings.

A bulb insertion part $A_1$ for attaching a wedged-base bulb and a plug-in part $A_2$ for coupling a connector are molded together from resin to constitute the body A of a bulb socket. During the molding process, two terminals B are partially embedded in the body A of the bulb socket integrally therewith so that the bulb contact parts $B_1$ of the terminal are located in the internal opening of the bulb insertion part $A_1$ and the connector contact parts $B_2$ of the terminals are located in the internal opening of the plug-in part $A_2$.

Each of the terminals B, which are made of a metal plate, integrally includes the bulb contact part $B_1$, which is electrically coupled to the wedged-base bulb and the connector contact part $B_2$; , which is electrically coupled to the connector. The bulb contact part $B_1$ has contact portions 1 which elastically pinch the wedged part of the wedged-base bulb and are electrically coupled to the lead wires of the bulb, and a wall 2 formed nearly in a U shape so as to surround the contact portions. The contact portions 1 of the bulb contact part $B_1$ are formed in the same manner as a conventional bulb socket, but the wall 2, which extends above the contact portions and which is formed integrally therewith and has approximately a U shape so as to surround the contact portions, differs from the conventional bulb socket.

When the terminals B are to be partially embedded in the body A of the bulb socket when the body is molded from resin, the terminals are set in prescribed positions in a die for molding the socket body from the resin. At the time of molding, the openings inside the walls 2 of the bulb contact parts $B_1$ of the terminals B are closed by the core C of the die or the like so that molten resin does not flow into the contact portions 1 of the bulb contact parts.

According to the present invention, when terminals are partially embedded in the body of the bulb socket, molten resin does not flow into the contact portions of the bulb contact parts of the terminals, although the die for molding the body of the bulb socket from the resin need not be specially constituted as in a conventional bulb socket. The constitution of the die is thus simplified, reducing the cost of production of the bulb socket. Since the contact portions of the bulb contact parts of the terminals are surrounded by the walls of the bulb contact parts, the contact portions are prevented from being excessively spread when a bulb is inserted. For that reason, good resilience of the contact portions is maintained for a long period of time, reliably maintaining the electrical connection of the contact portions and the bulb for a long period of time.

Figure 6:
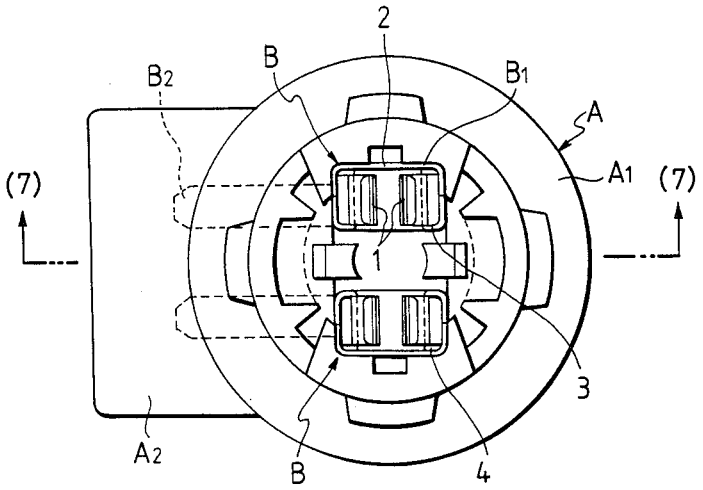
FIG. 6 shows a plan view of a bulb socket constructed according to a second preferred embodiment of the invention.
Figure 7:
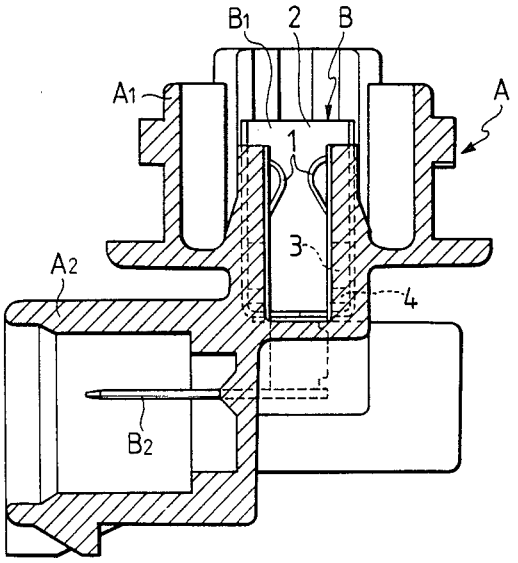
FIG. 7 is a sectional view of the bulb socket of FIG. 6 taken along a line (7)—(7) in FIG. 6.
Figure 8:
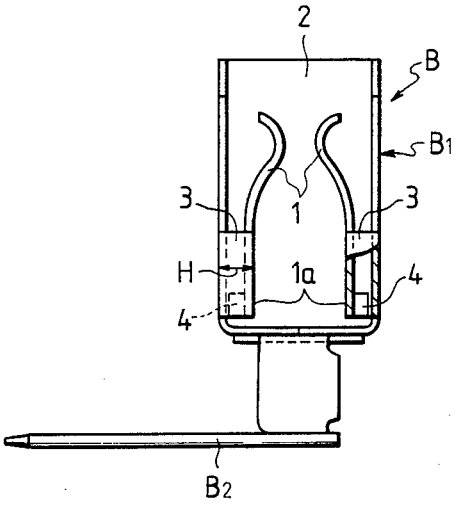
FIG. 8 shows a cut-away front view of each terminal of the bulb socket of FIG. 6.
Figure 9:
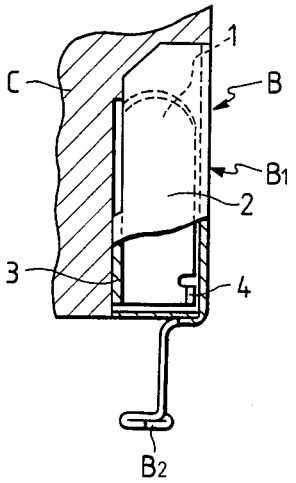
FIG. 9 shows a cut-away side view of the terminal.
Figure 10:
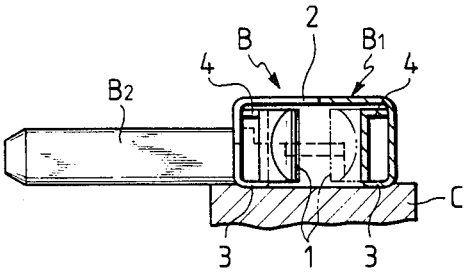
FIG. 10 shows a cut-away plan view of the terminal.

A second embodiment of the invention will be described with reference to FIGS. 6 through 10 of the drawings.

A bulb insertion part $A_1$ for attaching a wedged-base bulb and a plug-in part $A_2$ for coupling a connector are molded together from resin to constitute the body A of the socket. During the molding process, two terminals B are partially embedded in the body A of the socket integrally therewith so that the bulb contact parts $B_1$ of the terminals are located in the internal opening of the bulb insertion part $A_1$ of the socket body, and the connector contact parts $B_2$ of the terminals are located in the internal opening of the plug-in part $A_2$.

Each of the terminals B, which are made of a metal plate, integrally includes the bulb contact part $B_1$, which is electrically coupled to the wedged-base bulb, and the connector contact part $B_2$, which is electrically coupled to a connector. The bulb contact part $B_1$ has contact portions 1 which elastically pinch the wedged part of the bulb and are electrically coupled to the lead wires of the bulb, a wall 2 formed in approximately a U shape so as to surround the contact portions, coupling portions 3 joining the contact portions to the wall, and touch portions 4 located in contact with the inside surface of the wall. The contact portions 1 of the bulb contact parts $B_1$ have the same form as a conventional socket. The bulb socket of this embodiment, however, differs from the conventional socket in that coupling portions 3 of relatively large width H are provided continuously with the bottoms 1*a* of the contact portions and joining the contact portions to the wall 2, which extends above and surrounds the contact portions, and also in that the touch portions 4 of nearly the same width as the coupling portions are provided at the bottoms of the contact portions opposite the coupling portions and extending toward the inside surface of the wall in parallel with the coupling portions.

When the terminals B are to be partially embedded in the body A of the socket when the socket body is molded from resin, the terminals are set in prescribed positions in a molding die, and the openings inside the walls 2 of the bulb contact parts $B_1$ of the terminals are closed by a core C. As a result, the terminals are integrated with the body of the socket and the molten resin does not flow into the contact portions 1 of the bulb contact parts of the terminals when the socket is molded from resin.

According to the above-described second embodiment of the invention, when terminals are partially embedded in the body of the bulb socket in molding the socket body from resin, the molten resin does not flow into the contact portions of the bulb contact parts of the terminals, although the die for molding the socket body from the resin need not be specially constituted. The constitution of the die is thus simplified, reducing the costs of production of the bulb socket. Since the contact portions and the walls of the bulb contact parts of the terminals are joined to each other by coupling portions of relatively large width, molten resin is more surely prevented from flowing into the contact portions. Since the contact portions are surrounded by the walls and supported by the coupling portions and touch portions located in contact with the inside surfaces of the walls, plastic deformation and excessive spreading of the contact portions when a bulb is inserted are more surely prevented than in a conventional bulb socket, thereby maintaining good resilience of the contact portions for a long period of time and thus maintaining a reliable electrical connection of the socket and the bulb for a long period of time.

What is claimed is:

1. A socket for a wedge-base bulb, comprising: a molded-resin body, and a plurality of terminals partially embedded in said body as said body is molded, bulb contact parts of said terminal being formed with a wall having an approximately U shape so as to completely surround contact portions which pinch parts of said bulb on at least three sides, said wall acting as a barrier to the flow of molding material as said body is molded.

2. The socket for a wedge-base bulb of claim 1, wherein said wall extends above said contact portions.

3. A socket for a wedge-shaped bulb, comprising: a molded-resin body, and a plurality of terminals partially embedded in said body as said body is molded, bulb contact parts of said terminals comprising contact portions which pinch a wedged part of said bulb, a wall having an approximately U shape so as to completely surround said contact portions on at least three sides, said wall acting as a barrier to the flow of molten resin material as said body is molded, coupling portions joining said contact portions to said wall and having a relatively large width, and touch portions having approximately the same width as said coupling portions and extending from said contact portions toward an inside surface of said wall.

* * * * *